US008172217B2

(12) United States Patent
Tamura et al.

(10) Patent No.: US 8,172,217 B2
(45) Date of Patent: May 8, 2012

(54) SHEET MATERIAL TRANSPORT APPARATUS AND RECORDING APPARATUS

(75) Inventors: Tetsuya Tamura, Matsumoto (JP); Akira Nemura, Matsumoto (JP); Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/015,489

(22) Filed: Jan. 27, 2011

(65) Prior Publication Data

US 2011/0187050 A1 Aug. 4, 2011

(30) Foreign Application Priority Data

Jan. 29, 2010 (JP) ..... 2010-018143

(51) Int. Cl.
*B65H 5/00* (2006.01)
*B65H 5/22* (2006.01)

(52) U.S. Cl. ..... 271/4.04; 271/10.04

(58) Field of Classification Search ..... 271/4.04, 271/10.04

See application file for complete search history.

(56) References Cited

U.S. PATENT DOCUMENTS

| | | | | |
|---|---|---|---|---|
| 6,142,467 | A * | 11/2000 | Funada | 271/246 |
| 7,136,202 | B2 * | 11/2006 | Jang et al. | 358/474 |
| 7,708,262 | B2 * | 5/2010 | Boleda | 271/4.04 |
| 7,748,695 | B2 * | 7/2010 | Miura et al. | 271/10.13 |
| 2003/0209849 | A1 * | 11/2003 | Lee et al. | 271/10.04 |

FOREIGN PATENT DOCUMENTS

JP 2008-074582 4/2008

* cited by examiner

*Primary Examiner* — David H Bollinger
(74) *Attorney, Agent, or Firm* — Workman Nydegger

(57) ABSTRACT

A sheet material transport apparatus includes a second planetary gear engaging with a transmission gear and providing planetary motion around the transmission gear. The second planetary gear is in a second separated position not capable of engaging with a first planetary gear during forward-direction rotation. The transmission gear engages with the first planetary gear and rotates in a direction that causes a second transport roller to rotate in the forward rotation direction, and positioned to engage with the first planetary gear that is positioned in a first engaging position during reverse rotation. A load is placed on the transmission gear by the second transport roller. The transmission gear rotates in the opposite direction to the forward-direction rotation. The second planetary gear applies a force on the first planetary gear in the direction that separates the first planetary gear from the transmission gear due to rotation.

10 Claims, 7 Drawing Sheets

SHEET MATERIAL TRANSPORT APPARATUS AND RECORDING APPARATUS

The entire disclosure of Japanese Patent Application No. 2010-018143, filed Jan. 29, 2010 is expressly incorporated by reference herein

BACKGROUND

1. Technical Field

The present invention relates to sheet material transport apparatuses and recording apparatuses.

2. Related Art

Ink jet printers, such as that disclosed in JP-A-2008-74582, are known as recording apparatuses that carry out recording processes on a recording medium.

As disclosed in JP-A-2008-74582, in a sheet material transport apparatus that transports various types of sheet material such as paper, cloth, film, or the like, a gear train mechanism that includes a planetary gear capable of engaging with and disengaging from a transmission gear through planetary motion and that switches the transmission of mechanical power to the transmission gear between on and off through the planetary motion of the planetary gear has been widely used for some time.

However, depending on the positional relationship between the planetary gear and the transmission gear, there are cases where, when the planetary gear attempts to separate from the transmission gear, the rotational direction of the transmission gear is a direction that interferes with the separation of the planetary gear; as a result, there are cases where the teeth of the planetary gear become caught in the teeth of the transmission gear, making it impossible for the planetary gear to separate from the transmission gear. In particular, when the planetary gear attempts to separate from the transmission gear, if the transmission gear rotates in the opposite direction due to reasons aside from the rotational effects imparted by the planetary gear, it is even more difficult for the planetary gear to separate from the transmission gear.

SUMMARY

An advantage of some aspects of the invention is to prevent a transmission gear from stopping a planetary gear due to the rotation of the transmission gear when the planetary gear attempts to separate from the transmission gear, and to provide a sheet material transport apparatus and a recording apparatus capable of causing the planetary gear to separate from the transmission gear with certainty even in the case where the transmission gear has been rotated in the rotational direction that exacerbates the aforementioned stopping.

A sheet material transport apparatus according to an aspect of the invention includes: a first transport roller and a second transport roller that transport a sheet material; and a gear train mechanism that, when the first transport roller rotates in the forward rotation direction and the backward rotation direction, transmits the rotational driving force of the first transport roller to the second transport roller and causes the second transport roller to undergo slave rotation in the forward rotation direction. The gear train mechanism has: a transmission gear that transmits the rotational driving force to the second transport roller; a sun gear that rotates in one of a forward direction and a backward direction based on the rotational driving of the first transport roller; a first planetary gear, provided so as to engage with the sun gear and to be capable of planetary motion around the sun gear, that is positioned in a first engaging position capable of engaging with the transmission gear when the sun gear undergoes forward-direction rotation and a first separated position not capable of engaging with the transmission gear when the sun gear undergoes reverse-direction rotation; and a second planetary gear, provided so as to engage with the transmission gear and to be capable of planetary motion around the transmission gear, the second planetary gear being positioned in a second separated position not capable of engaging with the first planetary gear during forward-direction rotation, where the transmission gear engages with the first planetary gear and the transmission gear rotates in the direction that causes the second transport roller to rotate in the forward rotation direction, and positioned in a second engaging position capable of engaging with the first planetary gear that is positioned in the first engaging position during reverse-direction rotation, where a load is placed on the transmission gear by the second transport roller and the transmission gear rotates in the opposite direction to the forward-direction rotation, and the second planetary gear applying a force on the first planetary gear in the direction that separates the first planetary gear from the transmission gear due to rotation in the second engaging position.

By employing such a configuration, with the invention, the second planetary gear, which engages with the first planetary gear and applies a force on the first planetary gear in the direction that separates the first planetary gear from the transmission gear when the sun gear switches from forward-direction rotation to reverse-direction rotation, is provided, and thus it is possible to prevent the transmission gear from stopping the first planetary gear due to the rotation of the transmission gear when the first planetary gear attempts to separate from the transmission gear; it is thus possible to cause the first planetary gear to separate from the transmission gear with certainty even in the particular case where the transmission gear has been rotated in the rotational direction that exacerbates the aforementioned stopping.

According to another aspect of the invention, the gear train mechanism has: an arm member, provided in a freely-rotatable state with a rotational shaft of the transmission gear serving as the point of support of the arm member, that supports the second planetary gear in a freely-rotatable state; and a spring member that biases the second planetary gear toward the arm member and that applies rotation resistance to the arm member.

By employing such a configuration, with the invention, the arm member freely-rotatable with the rotational shaft of the transmission gear serving as the point of support of the arm member is provided, and the second planetary gear is supported on the arm member in a freely-rotatable state. When the configuration is such that the spring member that biases the second planetary gear toward the arm member is provided and rotation resistance is applied to the arm member, it is possible for the arm member to displace in the same direction as the rotational direction of the transmission gear when the transmission gear rotates, which in turn makes it possible to cause the second planetary gear to move in that rotational direction. Accordingly, it is possible to cause the second planetary gear to move into the second separated position or the second engaging position in accordance with the rotational direction of the transmission gear.

According to another aspect of the invention, the gear train mechanism includes a regulating member that regulates the rotation of the arm member, whose point of support is the rotational shaft of the transmission gear, between the second separated position and the second engaging position.

By employing such a configuration, in the invention, the rotational range of the arm member is regulated to the necessary minimum between the second separated position and the second engaging position, which makes it possible to prevent the arm member from coming into contact with the other constituent elements and reduce the time required for the second planetary gear to move from the second separated position to the second engaging position.

According to another aspect of the invention, the gear train mechanism has: a second transmission gear that engages with the transmission gear and transmits the rotational driving force to the second transport roller; and a third planetary gear, provided so as to engage with the sun gear and to be capable of planetary motion around the sun gear, that is positioned in a third separated position not capable of engaging with the second transmission gear when the sun gear undergoes forward-direction rotation and is positioned in a third engaging position capable of engaging with the second transmission gear when the sun gear undergoes reverse-direction rotation.

By employing such a configuration, in the invention, the first planetary gear is positioned in the first separated position when the sun gear undergoes reverse-direction rotation, thus stopping the transmission of rotational driving force from the first planetary gear to the transmission gear; however, at this time, the third planetary gear is positioned in the third engaging position, and thus rotational driving force is transmitted to the second transmission gear. On the other hand, when the sun gear undergoes forward-direction rotation, the first planetary gear is positioned in the first engaging position and transmits rotational driving force to the transmission gear; however, at this time, the third planetary gear is positioned in the third separated position, and thus the transmission of rotational driving force from the third planetary gear to the second transmission gear is stopped. Accordingly, the second transport roller can be caused to undergo slave rotation in the forward rotation direction even if the sun gear rotates in either the forward direction or the reverse direction based on the rotational driving of the first transport roller.

According to another aspect of the invention, the gear train mechanism includes a second arm member, provided in a freely-rotatable state with a rotational shaft of the sun gear serving as the point of support of the second arm member, that supports the first planetary gear in a freely-rotatable state and supports the third planetary gear in a freely-rotatable state, and a second spring member that biases the first planetary gear or the third planetary gear toward the second arm member and that applies rotation resistance to the second arm member; and the second arm member is provided so as to be freely rotatable between a forward-direction rotation position in which the first planetary gear is positioned in the first engaging position and the third planetary gear is positioned in the third separated position, and a backward-direction rotation position in which the first planetary gear is positioned in the first separated position and the third planetary gear is positioned in the third engaging position.

By employing such a configuration, in the invention, the second arm member with the rotational shaft of the sun gear serving as the point of support of the second arm member is provided in a freely-rotatable state, the first planetary gear and the second planetary gear are supported on the second arm member in a freely-rotatable state, and the relative distance between the two is held constant. Furthermore, the second arm member is capable of linking the planetary motion of the first and third planetary gears, so that when the sun gear undergoes forward-direction rotation, the first planetary gear is positioned in the first engaging position and the third planetary gear is positioned in the third separated position, whereas when the sun gear undergoes reverse-direction rotation, the first planetary gear is positioned in the first separated position and the third planetary gear is positioned in the third engaging position. Further still, because these two planetary gears are linked by the second arm member, when a second spring member that biases the first planetary gear or the third planetary gear toward the second arm member and applies rotation resistance to the second arm member is provided, the second arm member can be displaced in the same direction as the rotational direction thereof in accordance with the rotational direction of the sun gear, without providing a spring member on the other of the planetary gears.

According to another aspect of the invention, a recording apparatus includes: the sheet material transport apparatus described above; and a recording unit that performs a recording process on the sheet material transported by the sheet material transport apparatus.

By employing such a configuration, in the invention, a sheet material transport apparatus that, when the first planetary gear attempts to separate from the transmission gear, prevents the transmission gear from stopping the first planetary gear due to the rotation thereof is provided; it is thus possible to smoothly execute nip-and-release skew removal using the first transport roller and the second transport roller, which in turn makes it possible to record onto the sheet material with precision, having corrected the skew.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
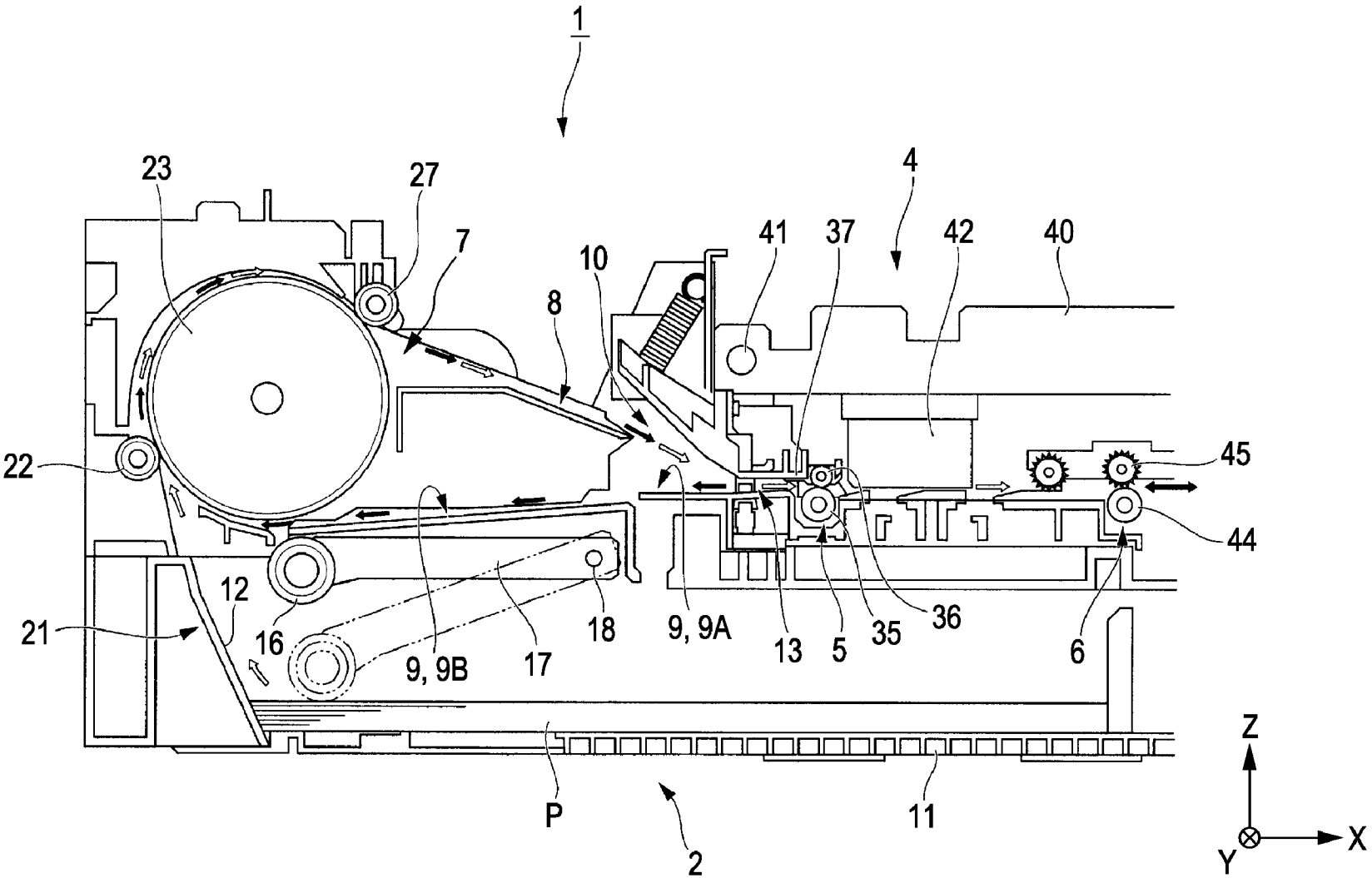
FIG. 1 is a cross-sectional side view illustrating a paper transport path in a printer according to an embodiment of the invention.

An embodiment of a sheet material transport apparatus and a recording apparatus according to the invention will be described hereinafter with reference to the drawings. It should be noted that in the drawings used in the following descriptions, the scale of the various constituent elements has been appropriately changed in order to achieve sizes that are more visibly recognizable. In this embodiment, an ink jet printer (called simply a "printer" hereinafter) will be given as an example of a recording apparatus according to the invention.

FIG. 1 is a cross-sectional side view illustrating a paper transport path in a printer 1 according to an embodiment of the invention.

It should be noted that in the following descriptions, as shown in FIG. 1, an XYZ orthogonal coordinate system is employed, and the positional relationships of the various constituent elements will be described with reference to this XYZ orthogonal coordinate system. A predetermined direction in the horizontal plane is taken as the X axis direction, the direction that is orthogonal to the X axis direction relative to the horizontal plane is taken as the Y axis direction, and the direction that is orthogonal to both the X axis direction and the Y axis direction (in other words, the vertical direction) is taken as the Z axis direction.

Hereinafter, the overall configuration of the printer 1 will be generally described with reference to FIG. 1. In order to illustrate all of the rollers disposed in the paper transport path of the printer 1, all of the rollers are depicted as being aligned with the same surface in FIG. 1; however, it is not necessarily the case that the positions of the rollers in the depth direction (that is, the Y axis direction) match (although there are some cases where the positions do match).

The printer 1 includes a paper feed unit (sheet material transport apparatus) 2; the configuration is such that paper (a sheet material) P serving as a recording medium is fed out from the paper feed unit 2 one sheet at a time and subjected to ink jet recording in a recording unit 4, after which the paper P is discharged toward a paper discharge stacker (not shown) provided in the forward side (the +X direction) of the apparatus. The printer 1 also includes, in a rear portion of the apparatus, a detachable dual-side unit 7, which buckles and inverts the paper P so that a second surface thereof, which is the opposite surface to a first surface onto which recording is carried out first, is opposed to a recording head 42, thus making it possible for recording to be executed on both sides of the paper P.

The paper feed unit 2 includes a paper cassette 11, a pickup roller 16, and a separating unit 21. The paper cassette 11, which is capable of holding multiple pieces of the paper P in a stacked state, is configured so as to be mountable in and removable from the forward side of the main body of the paper feed unit 2; meanwhile, the pickup roller 16, which is rotationally driven by a motor (not shown), is provided in a swinging member 17 that swings central to a swinging shaft 18, and is configured so as to feed out the uppermost piece of paper P from the paper cassette 11 in the −X direction (the feed-out direction) by making contact with the paper held in the paper cassette 11 and rotating.

A separating member 12 is provided in a location that opposes the leading edge of the paper held in the paper cassette 11, and a first-stage separation, in which the uppermost piece of paper P is separated from the remaining paper P, is carried out by the leading edge of the uppermost piece of paper P that is to be supplied advancing in the downstream direction while sliding along the separating member 12. The separating unit 21, which performs a second-stage separation on the paper P, is provided downstream from the separating member 12, and is configured so as to include a separating roller 22 and an intermediate roller 23. Furthermore, an assist roller 27 that undergoes slave rotation by nipping the paper P with the intermediate roller 23 is provided downstream from the separating unit 21.

The paper feed unit 2 also includes a transport unit 5 and a discharge unit 6. The transport unit 5 is configured so as to include a transport driving roller 35 that is rotationally driven by a motor (not shown in the diagrams) and a transport slave roller 36, axially supported on a guide face portion 37, that undergoes slave rotation by pressing against the transport driving roller 35; the paper P is fed by the transport unit 5 with high precision toward a position that opposes the recording head 42.

A paper edge detection sensor 13 is provided in the guide face portion 37 that is upstream from the transport unit 5. The paper edge detection sensor 13 is a sensor that detects the positions of the leading edge and the following edge of the paper P, and in this embodiment, a mechanical sensor that detects the edges of the paper P through a mechanical mechanism is employed. To be more specific, the paper edge detection sensor 13 includes a lever that protrudes from the guide face portion 37 toward a second transport path 9 (mentioned later) and that is capable of rotating around a shaft that extends in the Y axis direction; the configuration is such that the edges of the paper P are detected by detecting the rotation of the lever when the lever makes contact with the paper P.

Note that skew in the paper P fed by the paper feed unit 2 is corrected by nip-and-release skew removal control that uses the transport driving roller 35 (a first transport roller) and the intermediate roller 23 (a second transport roller) upstream from the transport driving roller 35.

To be more specific, after nipping the leading edge of the paper P between the transport driving roller 35 and the transport slave roller 36 and feeding the paper P a predetermined amount in the forward rotation direction (downstream), the transport driving roller 35 is rotated in the reverse direction while the upstream intermediate roller 23 is rotated in the forward rotation direction, thus ejecting the leading edge of the paper in the backward rotation direction (upstream direction) of the transport driving roller 35. Through this, the paper P is bent between the intermediate roller 23 and the transport driving roller 35, and the leading edge of the paper P traces the nip point of the transport driving roller 35 and the transport slave roller 36, thus correcting the skew.

Continuing on, the recording head 42 is provided in the base of a carriage 40, and the carriage 40 is driven by a motor (not shown in the drawings) so as to move back and forth in the main scanning direction (the Y axis direction) while being guided by a carriage guide shaft 41 that extends in the main scanning direction. The recording head 42 has a configuration capable of ejecting, for example, yellow (Y), magenta (M), cyan (C), and black (K) inks.

The discharge unit 6 provided downstream from the recording head 42 is configured so as to include a discharge driving roller 44 that is rotationally driven by a motor (not shown in the drawings) and a discharge slave roller 45 that undergoes slave rotation by making contact with the discharge driving roller 44; the paper P onto which recording has been carried out by the recording unit 4 is discharged by the discharge unit 6 to a stacker (not shown in the drawings) provided in the front side of the apparatus.

Furthermore, the paper feed unit 2 includes a first transport path 8 that transports the paper P at a predetermined height, the second transport path 9 that transports the paper P at a height that is lower than that of the first transport path 8, and a merging portion 10 where the first transport path 8 and the second transport path 9 merge. In the first transport path 8, the paper P is transported by the separating roller 22, the intermediate roller 23, and the assist roller 27. Meanwhile, in the second transport path 9, the paper P is transported by the transport driving roller 35, the transport slave roller 36, the discharge driving roller 44, and the discharge slave roller 45.

The second transport path 9 that is downstream from the merging portion 10 (9A) configures a shared transport path that leads the paper P to the recording head 42. On the other hand, the second transport path 9 that is upstream from the merging portion 10 (9B) configures a paper inverting transport path that merges with the first transport path 8 that is upstream from the merging portion 10.

In the case of dual-sided printing, the paper P has been transported along the second transport path 9A and onto whose first surface recording has been carried out, the side of the paper that was the following edge when the first surface was recorded onto becomes the leading edge due to backward rotation operations of the transport unit 5 and the discharge unit 6; the paper P is then directed into the second transport path 9B and led to between the separating roller 22 and the intermediate roller 23.

The intermediate roller 23 is rotationally driven in the clockwise direction in FIG. 1 by a motor (not shown in the drawings), and the paper that has been led to between the separating roller 22 and the intermediate roller 23 passes between the intermediate roller 23 and the assist roller 27, once again reaches the merging portion 10, and is led to the recording unit 4 via the second transport path 9A, after which the same recording process is executed.

Note that the configuration is such that the rotationally-driven rollers provided in the paper transport path described above, such as the pickup roller 16, the intermediate roller 23, the transport driving roller 35, and the discharge driving roller 44, are all rotationally driven by a common driving motor.

A gear train mechanism 50 according to the invention is provided between the intermediate roller 23 and the transport driving roller 35.

Hereinafter, the gear train mechanism 50 according to an embodiment of the invention will be described with reference to FIGS. 2 through 11.

Figure 2:
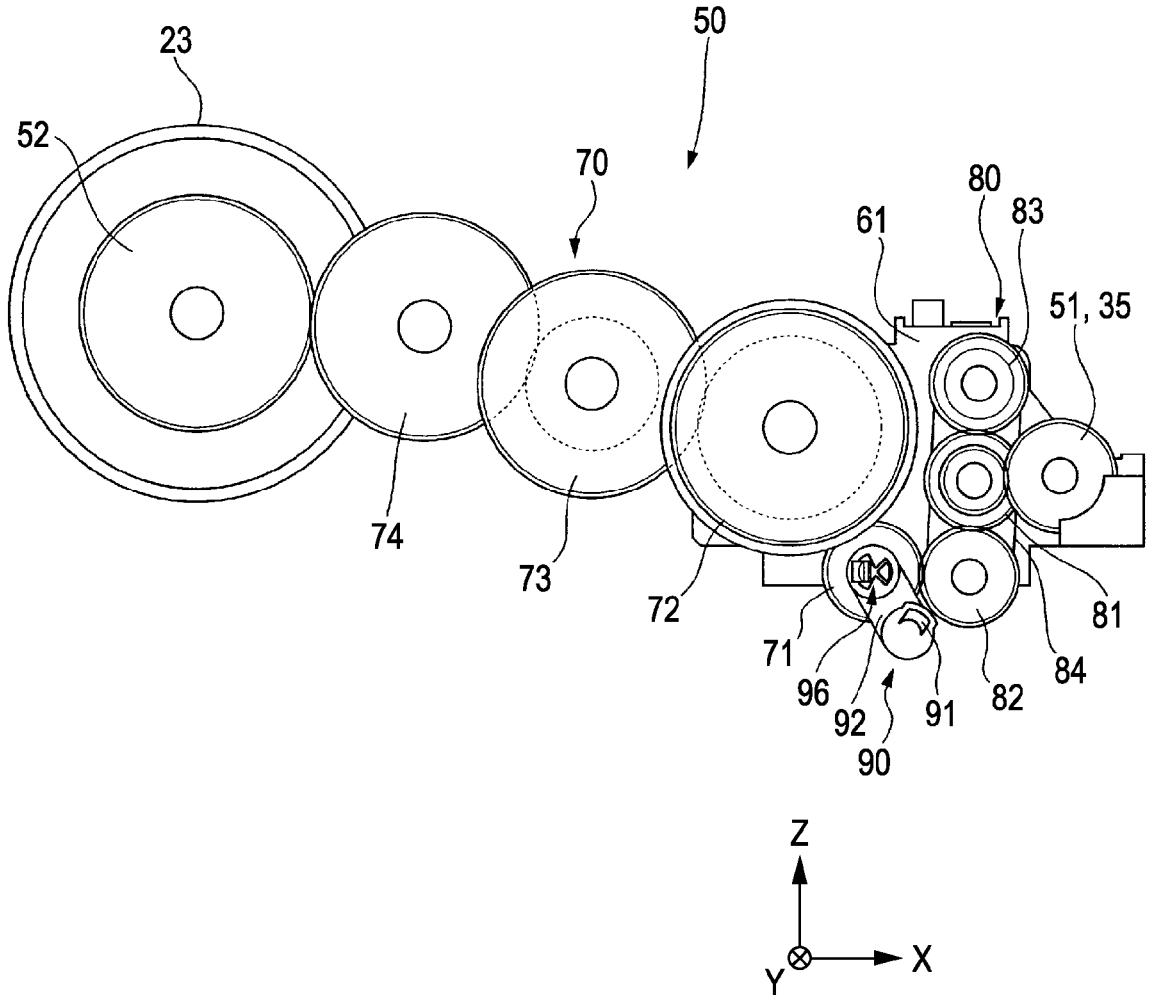
FIG. 2 is a side view illustrating the configuration of a gear train mechanism according to an embodiment of the invention.
Figure 3:
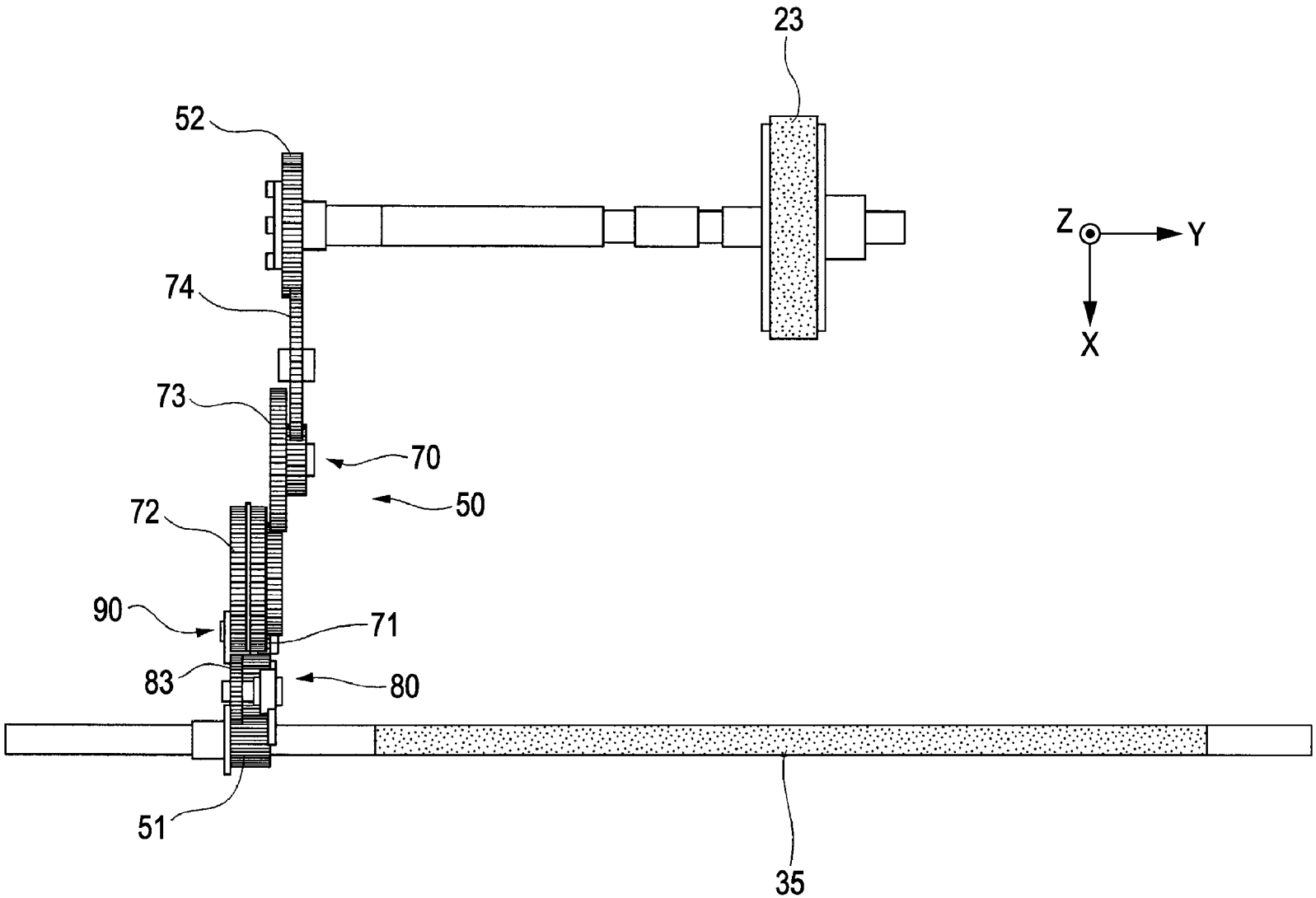
FIG. 3 is a plan view illustrating the configuration of a gear train mechanism according to an embodiment of the invention.

FIG. 2 is a side view illustrating the configuration of the gear train mechanism 50 according to an embodiment of the invention. FIG. 3 is a plan view illustrating the configuration of the gear train mechanism 50 according to an embodiment of the invention.

In FIG. 2, a reference numeral 61 indicates part of a side frame that configures the −Y side side-surface of a transport path, and part of the gear train mechanism 50 is provided in this side frame 61; the remainder of the gear train mechanism 50 is provided in the rest of the side frame of which the main body of the printer 1 is configured, the dual-side unit 7, and so on.

A driving gear 51 is provided on the shaft end of the −Y side of the transport driving roller 35, the driving gear 51 rotating along with that roller. The driving gear 51 is configured so as to be capable of rotation in the clockwise direction that feeds the paper P in the forward rotation direction (the +X direction) (that is, rotation in the forward rotation direction) or rotation in the counter-clockwise direction that feeds the paper P in the backward rotation direction (the −X direction) (that is, rotation in the backward rotation direction), through driving performed by a driving motor (not shown).

An intermediate gear 52 is provided on the shaft end of the −Y side of the intermediate roller 23, the intermediate gear 52 rotating along with that roller. The intermediate gear 52 is configured so as to be capable of slave rotation in the clockwise direction that feeds the paper P in the forward rotation direction (the +X direction) (that is, slave rotation in the forward rotation direction) as a result of rotational driving force of the driving gear 51 being transmitted thereto by the gear train mechanism 50 when the transport driving roller 35 rotates in the forward rotation direction and in the backward rotation direction.

The gear train mechanism 50 includes a transmission gear mechanism 70 that transmits rotational driving force to the intermediate gear 52, a planetary gear mechanism 80 that transmits rotational driving force to the transmission gear mechanism 70, and a planetary gear lock release mechanism 90 that releases the planetary gear mechanism 80 from a locked state (mentioned later).

The transmission gear mechanism 70 includes a transmission gear 71, a transmission gear (second transmission gear) 72, a transmission gear 73, and a transmission gear 74. The transmission gears 71, 72, 73, and 74 are each axially supported, so as to be freely rotatable, by multiple rotation shafts that erect from the side frame 61 and so on. The transmission gear mechanism 70 is configured so that the transmission gear 71 and the transmission gear 72 engage, the transmission gear 72 and the transmission gear 73 engage, the transmission gear 73 and the transmission gear 74 engage, and the transmission gear 74 and the intermediate gear 52 engage.

In this embodiment, the transmission gear 71 and the transmission gear 74 are configured of spur gears, whereas the transmission gear 72 and the transmission gear 73 are configured of compound gears in which large-diameter gears and small-diameter gears are combined into one entity. The transmission gear 71 is configured so as to have a smaller diameter than the other transmission gears. Due to the engagement relationship illustrated in FIG. 3, the transmission gear mechanism 70 is configured so as to adjust the axle ratio (gear ratio).

Note that the transmission gear 71 configures part of the planetary gear lock release mechanism 90, which will be described later.

The planetary gear mechanism 80 includes a sun gear 81, a planetary gear (first planetary gear) 82, and a planetary gear (third planetary gear) 83.

The sun gear 81 is configured so as to engage with the driving gear 51 and rotate in either a first direction or a second direction based on the rotational driving of the driving gear 51.

Hereinafter, the counter-clockwise rotation of the sun gear 81 when the driving gear 51 rotates in the clockwise direction (that is, rotates in the forward rotation direction) will be referred to as rotation in the first direction (reverse-direction rotation). Meanwhile, the clockwise rotation of the sun gear 81 when the driving gear 51 rotates in the counter-clockwise direction (that is, rotates in the backward rotation direction) will be referred to as rotation in the second direction (forward-direction rotation).

Figure 7:
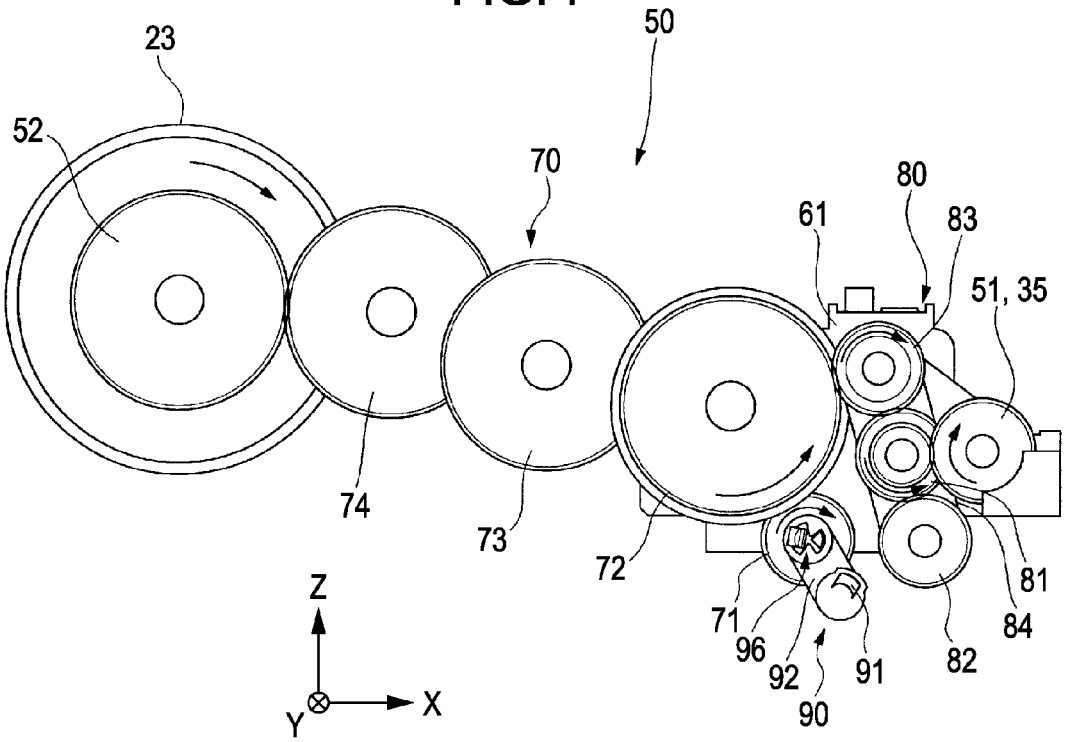
FIG. 7 is a diagram illustrating the rotational state of the forward rotation direction of a transport driving roller according to an embodiment of the invention.

The planetary gear 82 engages with the sun gear 81 and is provided so as to be capable of planetary motion around the sun gear 81, and the configuration is such that the planetary gear 82 is positioned in an engaging position (a first engaging position) capable of engaging with the transmission gear 71 when the sun gear 81 rotates in the second direction (clockwise rotation) (see FIG. 8), and is positioned in a separated position (a first separated position) not capable of engaging with the transmission gear 71 when the sun gear 81 rotates in the first direction (counter-clockwise rotation) (see FIG. 7).

On the other hand, the planetary gear 83 engages with the sun gear 81 and is provided so as to be capable of planetary motion around the sun gear 81, and the configuration is such that the planetary gear 83 is positioned in a separated position (a third separated position) not capable of engaging with the transmission gear 72 when the sun gear 81 rotates in the second direction (clockwise rotation) (see FIG. 8), and is positioned in an engaging position (a third engaging position) capable of engaging with the transmission gear 72 when the sun gear 81 rotates in the first direction (counter-clockwise rotation) (see FIG. 7).

According to this configuration, the planetary gear 82 is positioned in the first separated position when the sun gear 81 rotates in the first direction and the transmission of rotational driving force by the planetary gear 82 to the transmission gear 71 is released; however, at this time, because the planetary gear 83 is positioned in the third engaging position, rotational driving force is transmitted to the transmission gear 72. Meanwhile, the planetary gear 82 is positioned in the first engaging position when the sun gear 81 rotates in the second direction and transmits rotational driving force to the transmission gear 71; however, at this time, because the planetary gear 83 is positioned in the third separated position, the transmission of rotational driving force by the planetary gear 83 to the transmission gear 72 is released. Accordingly, regardless of whether the sun gear 81 is rotated in the first direction or the second direction due to the rotational driving of the transport driving roller 35, the intermediate roller 23 can be caused to undergo slave rotation in the forward rotation direction (see FIG. 7 and FIG. 8).

The planetary gear 82 and the planetary gear 83 are each axially supported in a freely-rotatable state upon an arm member (second arm member) 84 capable of swinging central to the rotational center of the sun gear 81. The arm member 84 mechanically links the planetary gear 82 and the planetary gear 83, and links the planetary motions of the two to each other while preventing the two from colliding and so on by maintaining a relative distance to be constant in the circumferential direction between the two and the sun gear 81 while shifting the phase thereof by, in this embodiment, 180 degrees. This arm member 84 is provided so as to be capable of swinging between a second direction rotation position in which the planetary gear 82 is positioned in the first engaging position and the planetary gear 83 is positioned in the third separated position (that is, a forward-direction rotation position: see FIG. 8) and a first direction rotation position in which the planetary gear 82 is positioned in the first separated position and the planetary gear 83 is positioned in the third engaging position (that is, a reverse-direction rotation position: see FIG. 7).

When the arm member 84 is positioned in the second direction rotation position, the planetary gear 82 and the transmission gear 71 engage, thus regulating the rotation of the arm member 84 in the counter-clockwise direction. Furthermore, at this time, the planetary gear 83 provided on the other side of the arm member 84 is idle in a position that cannot engage with the transmission gear 72 and the driving gear 51 (see FIG. 8).

When the arm member 84 is positioned in the first direction rotation position, the planetary gear 83 and the transmission gear 72 engage, thus regulating the rotation of the arm member 84 in the clockwise direction. Furthermore, at this time, the planetary gear 82 provided on the other side of the arm member 84 is idle in a position that cannot engage with the transmission gear 71 and the driving gear 51 (see FIG. 7).

Figure 4:
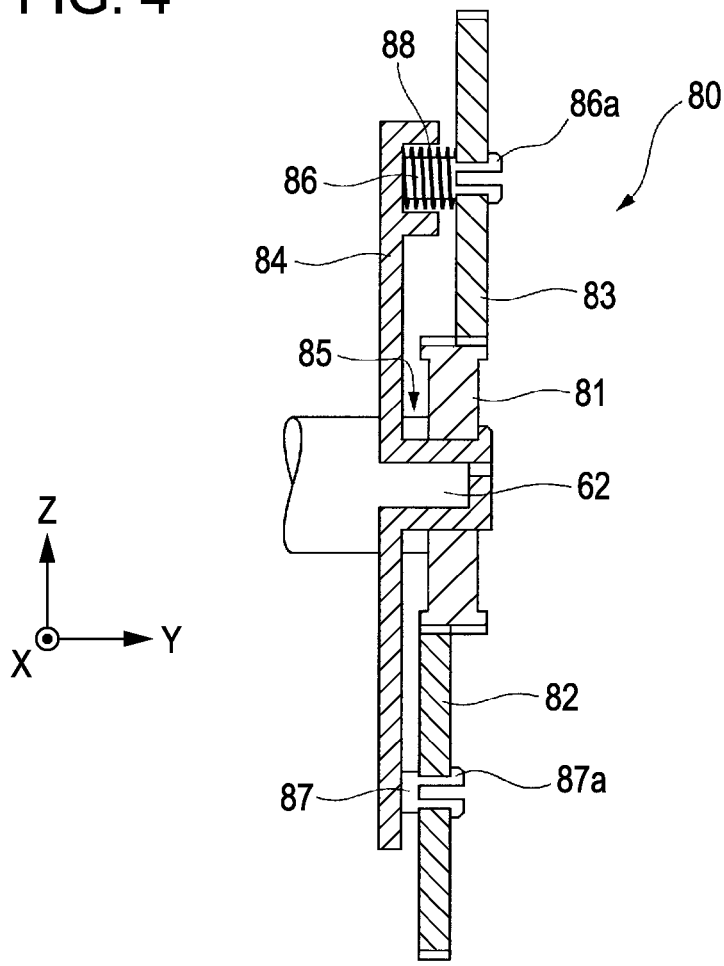
FIG. 4 is a cross-sectional view illustrating the configuration of a planetary gear mechanism according to an embodiment of the invention.

FIG. 4 is a cross-sectional view illustrating the configuration of the planetary gear mechanism 80 according to an embodiment of the invention.

The arm member 84 has a long shape that extends linearly in one direction, and a central portion 85 thereof is axially supported on a rotation shaft 62 that passes through the rotational center of the sun gear 81. The rotation shaft 62 is erected from the side frame 61. The central portion 85 of the arm member 84 is formed in an approximately cylindrical shape that follows the shape of the rotation shaft 62. The sun gear 81 is axially supported in a freely rotatable state on the central portion 85. Therefore, the configuration is such that the arm member 84 and the sun gear 81 are each freely rotatable about the rotation shaft 62.

One end (the end on the +Z side in FIG. 2) of the arm member 84 has a rotational shaft 86 that axially supports the planetary gear 83 in a freely rotatable state. A stopper 86*a* that prevents the planetary gear 83 from falling off in the −Y direction is provided integrally on the tip end of the rotational shaft 86.

Meanwhile, the other end of the arm member 84 (that is, the opposite end of the one end, with the central portion 85 therebetween, or the end on the −Z side in FIG. 2) has a rotational shaft 87 that axially supports the planetary gear 82 in a freely rotatable state. A stopper 87*a* that prevents the planetary gear 82 from falling off in the −Y direction is provided integrally on the tip end of the rotational shaft 87.

A pressure spring (second spring member) 88 that biases the planetary gear 83 toward the stopper 86*a* and imparts rotation resistance (friction) on the arm member 84 is provided on the one end of the arm member 84.

Providing the freely-rotatable arm member 84 with the rotation shaft 62 as a point of support, supporting the planetary gear 83 on the arm member 84 in a freely-rotatable state, and providing the pressure spring 88 that biases the planetary gear 83 toward the arm member 84 make it possible to displace the arm member 84 in the same direction as the rotational direction of the sun gear 81 when the sun gear 81 rotates.

In other words, when the sun gear 81 rotates in the counter-clockwise direction, the planetary gear 83 that engages therewith rotates in the clockwise direction; however, because the rotation reaction force at that time works as a force for rotating the arm member 84 in the counter-clockwise direction, the sun gear 81 and the arm member 84 rotate in the same direction (the counter-clockwise direction) (see FIG. 7). Meanwhile, when the sun gear 81 rotates in the clockwise direction, the planetary gear 83 that engages therewith rotates in the counter-clockwise direction; however, because the rotation reaction force at that time works as a force for rotating the arm member 84 in the clockwise direction, the sun gear 81 and the arm member 84 rotate in the same direction (the clockwise direction) (see FIG. 8).

Note that if the pressure spring 88 is provided only in the planetary gear 83 and rotation resistance is applied toward the arm member 84, as the planetary gear 82 at the other end is mechanically linked to the arm member 84, the arm member 84 can be displaced in the same direction as the rotational direction of the sun gear 81 without proving a pressure spring in that other end as well.

Returning to FIG. 2, the planetary gear lock release mechanism 90 includes the transmission gear 71 and a planetary gear (second planetary gear) 91.

The planetary gear 91 engages with the transmission gear 71 and is provided so as to be capable of planetary motion around the transmission gear 71. The planetary gear 91 is configured so as to be positioned in a second separated position (see FIG. 8) not capable of engaging with the planetary gear 82 when the transmission gear 71 has engaged with the planetary gear 82 and the transmission gear 71 undergoes forward-direction rotation that causes the intermediate roller 23 to rotate in the forward-rotation direction (that is, during clockwise rotation). Furthermore, the planetary gear 91 is configured so as to be positioned in a second engaging position (see FIG. 10) that is capable of engaging with the stated first planetary gear 82 that is positioned in the first engaging position when the intermediate roller 23 imparts a load on the transmission gear 71 (mentioned later) and the transmission gear 71 undergoes reverse-direction rotation in the direction opposite to the forward-direction rotation (that is, counter-clockwise rotation), and so as to apply a force on the planetary gear 82 in the direction that distances the planetary gear 82 from the transmission gear 71 as a result of rotation when in the second engaging position.

The planetary gear 91 is axially supported in a freely-rotatable state upon an arm member 92 capable of swinging central to the rotational center of the transmission gear 71.

Figure 5:
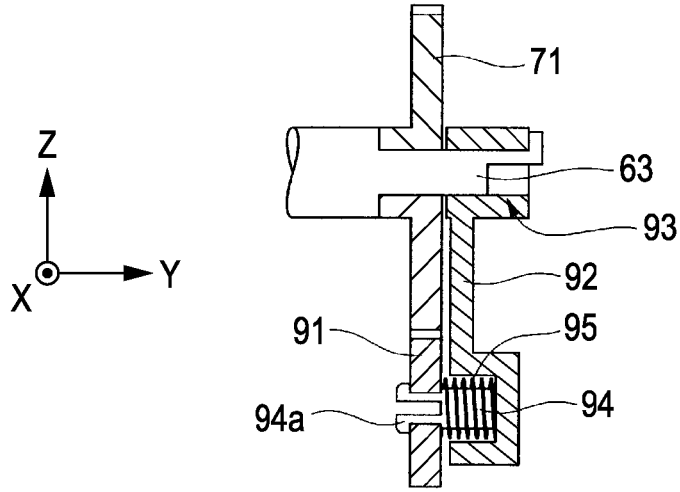
FIG. 5 is a cross-sectional view illustrating the configuration of a planetary gear lock release mechanism according to an embodiment of the invention.
Figure 6:
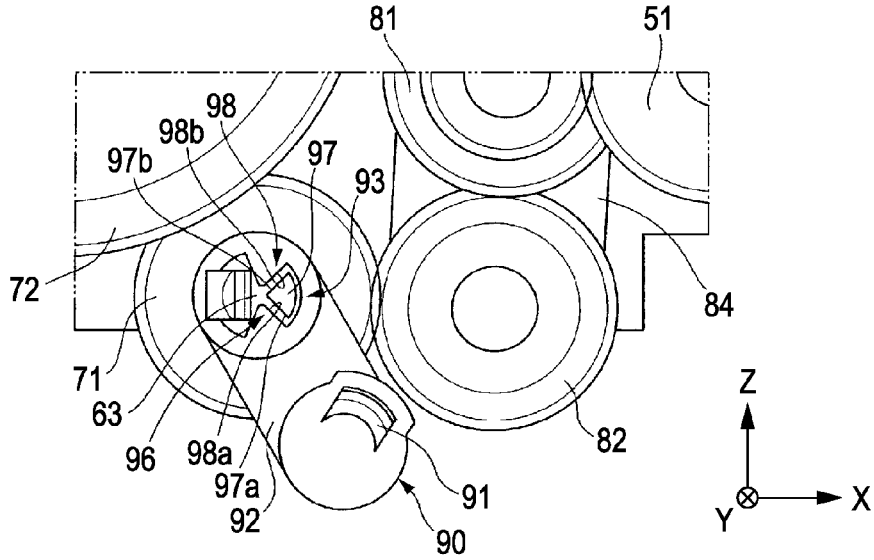
FIG. 6 is a side view illustrating the configuration of a planetary gear lock release mechanism according to an embodiment of the invention.

FIG. 5 is a cross-sectional view illustrating the configuration of the planetary gear lock release mechanism 90 according to an embodiment of the invention. FIG. 6 is a side view illustrating the configuration of the planetary gear lock release mechanism 90 according to an embodiment of the invention.

The arm member 92 has a long shape that extends linearly in one direction, and as shown in FIG. 5, a base end portion 93 thereof is axially supported on a rotation shaft 63 that passes through the rotational center of the transmission gear 71. The rotation shaft 63 is erected from the side frame 61. The tip end of the arm member 92 has a rotational shaft 94 that axially supports the planetary gear 91 in a freely rotatable state. A stopper 94*a* that prevents the planetary gear 91 from falling off in the +Y direction is provided integrally on the tip end of the rotational shaft 94.

A pressure spring (spring member) 95 that biases the planetary gear 91 toward the stopper 94*a* and imparts rotation resistance (friction) on the arm member 92 is provided on the tip end of the arm member 92.

Providing the freely-rotatable arm member 92 with the rotation shaft 63 as a point of support, supporting the planetary gear 91 on the arm member 92 in a freely-rotatable state, and providing the pressure spring 95 that biases the planetary gear 91 toward the arm member 92 make it possible to displace the arm member 92 in the same direction as the rotational direction of the transmission gear 71 when the transmission gear 71 rotates.

Figure 8:
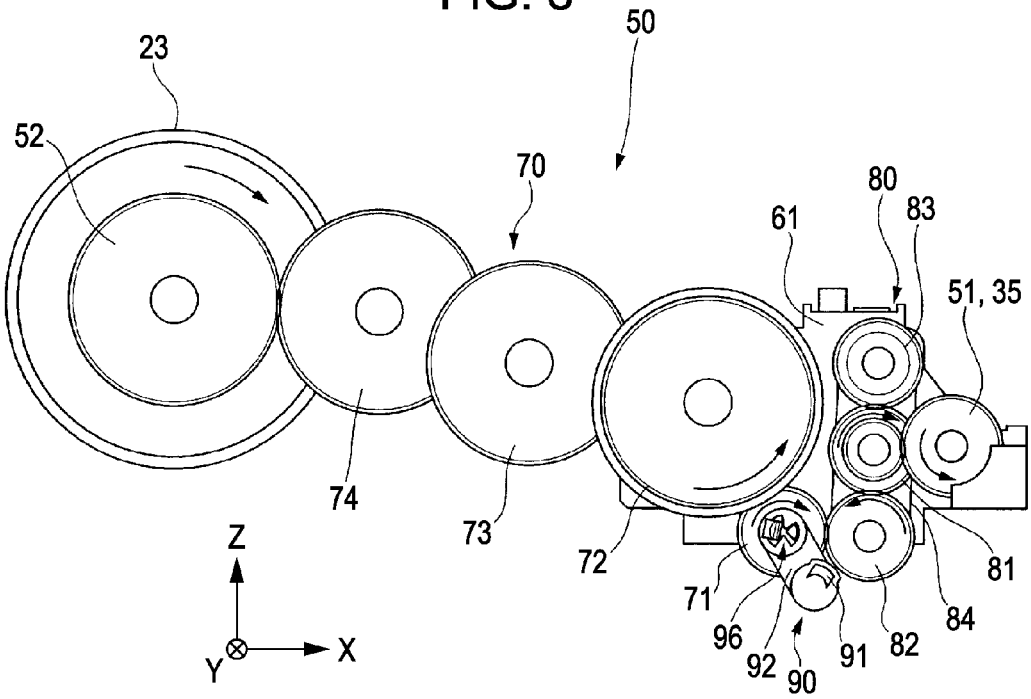
FIG. 8 is a diagram illustrating the rotational state of the backward rotation direction of a transport driving roller according to an embodiment of the invention.

In other words, when the transmission gear 71 rotates in the clockwise direction, the planetary gear 91 that engages therewith rotates in the counter-clockwise direction; however, because the rotation reaction force at that time works as a force for rotating the arm member 92 in the clockwise direction, the transmission gear 71 and the arm member 92 rotate in the same direction (the clockwise direction) (see FIG. 7 and FIG. 8). Furthermore, when the transmission gear 71 rotates in the counter-clockwise direction, the planetary gear 91 that engages therewith rotates in the clockwise direction; however, because the rotation reaction force at that time works as a force for rotating the arm member 92 in the counter-clockwise direction, the transmission gear 71 and the arm member 92 rotate in the same direction (the counter-clockwise direction) (see FIG. 11).

As shown in FIG. 6, the planetary gear lock release mechanism 90 includes a regulating portion (regulating member) 96 that regulates the rotation of the arm member 92, whose point of support is the rotational shaft of the transmission gear 71, between the second separated position and the second engaging position.

The regulating portion 96 is configured of a projection 97 that protrudes from the top of the rotation shaft 63 and a recess 98 which is formed in the base end portion 93 of the arm member 92 and into which the projection 97 is movably inserted. The projection 97 has a general fan shape, as illustrated in the side view in FIG. 6. Meanwhile, the recess 98 has a general fan shape that is slightly a size larger than the fan shape of the projection 97, as illustrated in the side view in FIG. 6.

When the transmission gear 71 rotates in the clockwise direction, the regulating portion 96 regulates the rotation of the arm member 92 to the second separated position by a side portion 98*a* of the recess 98 which stops a side portion 97*a* of the projection 97. Meanwhile, when the transmission gear 71 rotates in the counter-clockwise direction, the regulating portion 96 regulates the rotation of the arm member 92 to the second engaging position by a side portion 98*b* of the recess 98 which stops a side portion 97*b* of the projection 97, the side portions 97*b* and 98*b* being on the opposite side in the rotational direction of the transmission gear 71.

In other words, when the arm member 92 is positioned in the second separated position, the side portion 98*a* of the recess 98 stops the side portion 97*a* of the projection 97, thus regulating the clockwise rotation of the arm member 92. At this time, the planetary gear 91 is idle in a position that cannot engage with the transmission gear 72 and the planetary gear 82 (see FIG. 7, FIG. 8).

Next, overall operations of the gear train mechanism 50 configured as described above will be described with reference to FIGS. 7 through 11.

FIG. 7 illustrates the forward transportation direction rotational state of the transport driving roller 35.

In this state, the driving gear 51 rotates clockwise due to the driving of the driving motor (not shown) (that is, rotates in the forward rotation direction). When the driving gear 51 rotates in the forward rotation direction, the sun gear 81 that engages therewith rotates in the counter-clockwise direction (that is, rotates in the first direction). When the sun gear 81 rotates in the first direction, the arm member 84 rotates in the counter-clockwise direction and is positioned in the first direction rotation position. When the arm member 84 is positioned in the first direction rotation position, the planetary gear 83 is positioned in the third engaging position and engages with the transmission gear 72. When the planetary gear 83 rotates in the clockwise direction while in the third engaging position, the transmission gear 72 that engages therewith rotates in the counter-clockwise direction. When the transmission gear 72 rotates in the counter-clockwise direction, the transmission gear 73 and the transmission gear 74 rotate, and the intermediate gear 52 that engages with the transmission gear 74 undergoes slave rotation in the clockwise direction (that is, slave rotation in the forward rotation direction).

Note that when the transmission gear 72 rotates in the counter-clockwise direction, the transmission gear 71 that engages therewith rotates in the clockwise direction (that is, undergoes forward-direction rotation). When the transmission gear 71 rotates in the clockwise direction, the arm member 92 rotates in the clockwise direction and is positioned in the second separated position. When the arm member 92 is positioned in the second separated position, the regulating portion 96 regulates the rotation of the arm member 92 in the clockwise direction.

In other words, in this state, the paper P can be transported from upstream to downstream along the transport path.

FIG. 8 illustrates the backward transportation direction rotational state of the transport driving roller 35.

In this state, the driving gear 51 rotates counter-clockwise due to the driving of the driving motor (not shown) (that is, rotates in the backward rotation direction). When the driving gear 51 rotates in the backward rotation direction, the sun gear 81 that engages therewith rotates in the clockwise direction (that is, rotates in the second direction). When the sun gear 81 rotates in the second direction, the arm member 84 rotates in the clockwise direction and is positioned in the second direction rotation position. When the arm member 84 is positioned in the second direction rotation position, the planetary gear 82 is positioned in the first engaging position and engages with the transmission gear 71. When the planetary gear 82 rotates in the counter-clockwise direction while in the first engaging position, the transmission gear 71 that engages therewith rotates in the clockwise direction (that is, undergoes forward-direction rotation). When the transmission gear 71 rotates in the clockwise direction, the transmission gear 72 rotates in the counter-clockwise direction. When the transmission gear 72 rotates in the counter-clockwise direction, the transmission gear 73 and the transmission gear 74 rotate, and the intermediate gear 52 that engages with the transmission gear 74 undergoes slave rotation in the clockwise direction (that is, slave rotation in the forward rotation direction).

Note that when the transmission gear 71 rotates in the clockwise direction, the arm member 92 rotates in the clockwise direction and is positioned in the second separated position. When the arm member 92 is positioned in the second separated position, the regulating portion 96 regulates the rotation of the arm member 92 in the clockwise direction.

In the state shown in FIG. 8, when the transport driving roller 35 (driving gear 51) are driven backward in the state shown in FIG. 7 in order to carry out the aforementioned nip-and-release skew removal control, the planetary gear 83 separates from the transmission gear 72, and the planetary gear 82 engages with the transmission gear 71 instead; thus the rotational driving force is transmitted to the transmission gear mechanism 70.

At this time, the transport driving roller 35 on the downstream side is rotating in the backward rotation direction, but because the intermediate roller 23 on the upstream side continues to rotate in the forward rotation direction, the paper P is bent between the intermediate roller 23 and the transport driving roller 35; as a result, the leading edge of the paper is ejected upstream from the transport driving roller 35, thus removing the skew.

Note that when the transport driving roller 35 (driving gear 51) is once again switched to rotational driving in the forward rotation direction from the nip-and-release skew removal state illustrated in FIG. 8, the planetary gear 82 attempts to separate from the transmission gear 71; however, there are cases where a phenomenon in which the teeth of the planetary gear 82 become caught in the teeth of the transmission gear 71 and the planetary gear 82 is stopped occurs.

Descriptions of this caught phenomenon (a locked state) will be provided hereinafter with reference to FIG. 9 and FIG. 10. Note that in FIG. 9 and FIG. 10, the gear train mechanism 50 is illustrated without the planetary gear lock release mechanism 90, for descriptive purposes.

Figure 9:
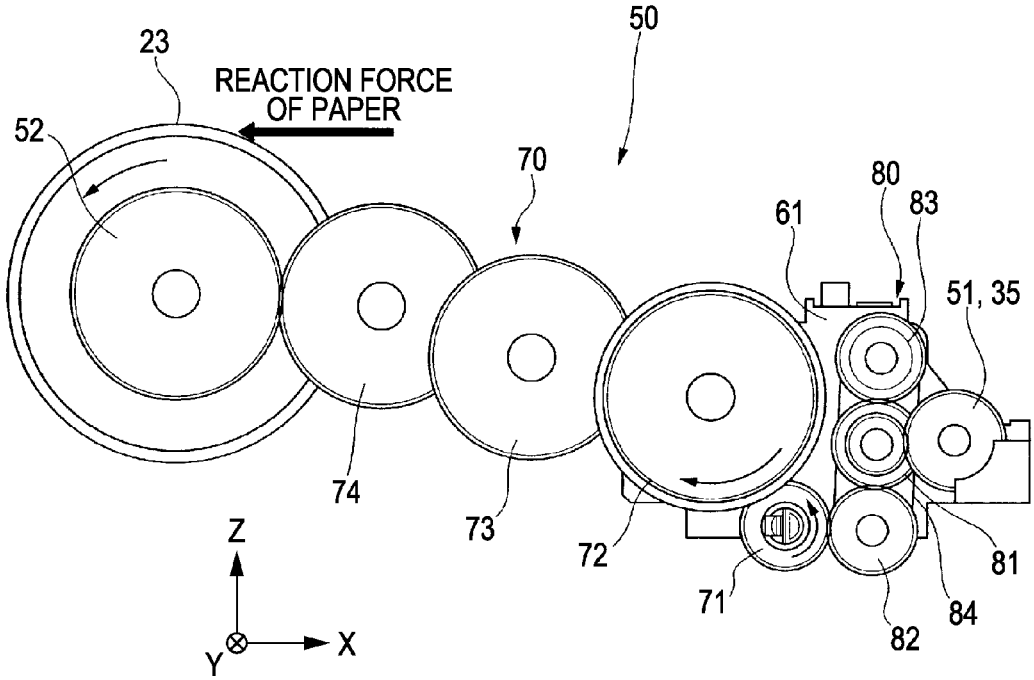
FIG. 9 is a diagram illustrating a locked state in a planetary gear mechanism according to an embodiment of the invention.
Figure 10:
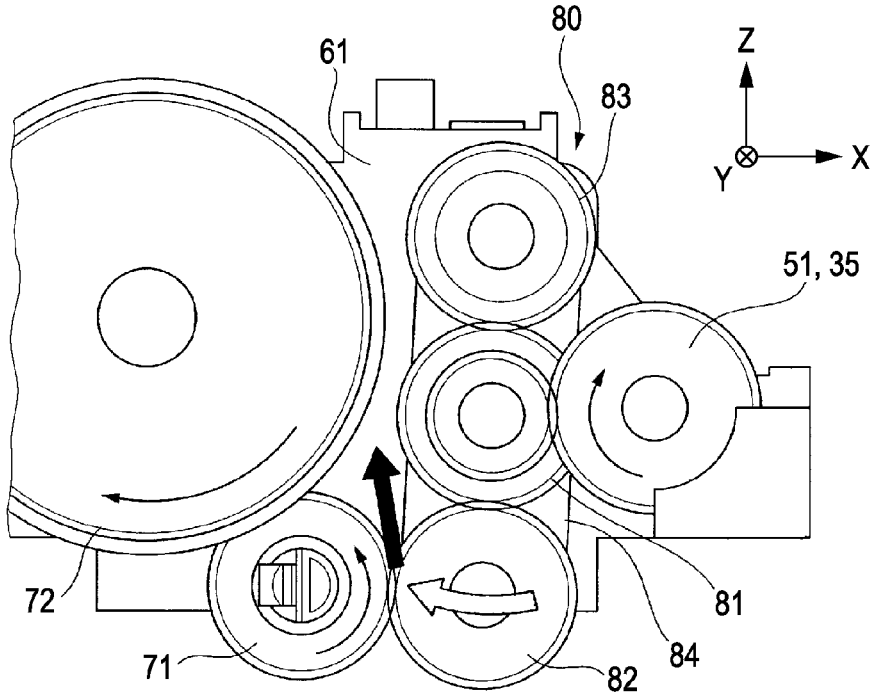
FIG. 10 is a diagram illustrating a locked state in a planetary gear mechanism according to an embodiment of the invention.
Figure 11:
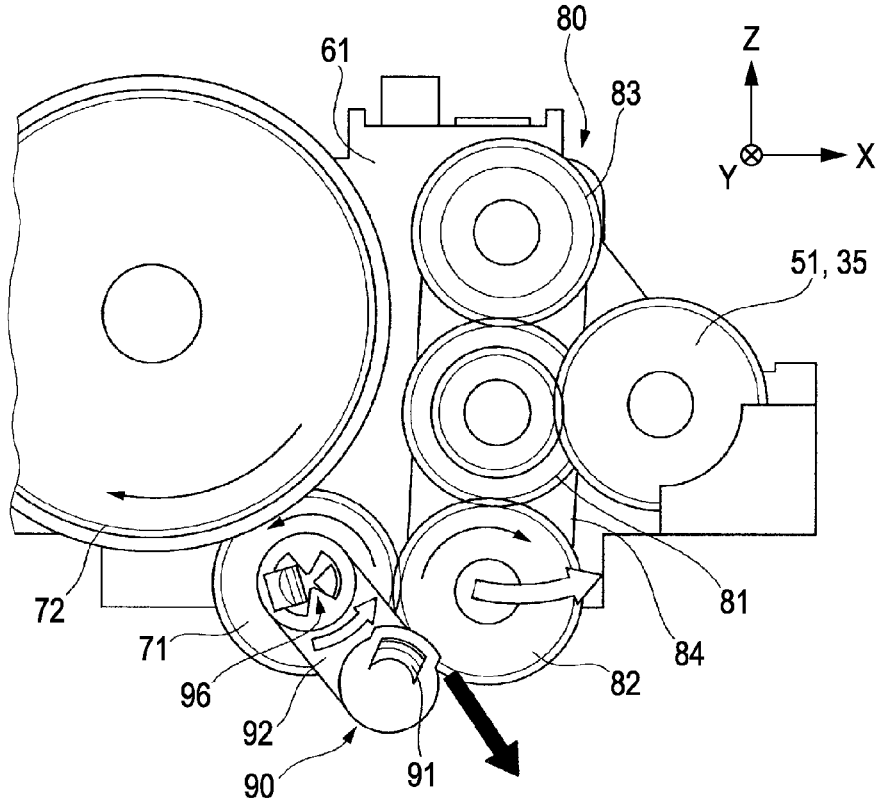
FIG. 11 is a diagram illustrating operations of the planetary gear lock release mechanism that releases a locked state in a planetary gear mechanism according to an embodiment of the invention.

In nip-and-release skew removal, the intermediate roller 23 is undergoing slave rotation in the forward rotation direction, and thus the paper P can be bent; however, at this time, the intermediate roller 23 is affected by the reaction force of the paper as shown in FIG. 9, and thus torque (a load) works in the opposite direction (the counter-clockwise direction) to the rotational direction (the clockwise direction) of the roller itself. Accordingly, when the transport driving roller 35 (driving gear 51) is switched to rotational driving in the forward rotation direction (that is, when the rotational driving force is temporarily interrupted), rotational driving force is transmitted to the transmission gear mechanism 70 due to that torque, resulting in cases where the transmission gear 71 rotates in the counter-clockwise direction (that is, undergoes reverse-direction rotation). As a result, as shown in FIG. 10, a force works toward causing the planetary gear 82 that is engaged with the transmission gear 71 to lock, resulting in the moment in the clockwise rotational direction on the arm member 84; as a result, the planetary gear mechanism 80 does not switch.

However, as described above, the gear train mechanism 50 includes the planetary gear lock release mechanism 90 that releases the locked state of the planetary gear mechanism 80. Hereinafter, operations for releasing the locked state of the planetary gear mechanism 80 will be described with reference to FIG. 11.

When torque is applied to the transmission gear 71 from the intermediate roller 23 and the transmission gear 71 rotates in the counter-clockwise direction (undergoes reverse-direction rotation), the arm member 92 rotates in the counter-clockwise direction, positioning the planetary gear 91 in the second engaging position. Note that the rotational range of the arm member 92 is regulated to the necessary minimum between the second separated position and the second engaging position by the regulating portion 96 and thus the displacement amount is set to be low; accordingly, the movement time of the planetary gear 91 from the second separated position to the second engaging position is reduced, resulting in the lack of a significant time lag when switching the driving of the transport driving roller 35, making it possible to commence the planetary motion of the planetary gear 91 quickly.

To the second engaging position, the transmission gear 71 is affected by the torque and rotates in the counter-clockwise direction, and thus the planetary gear 91 moves while rotating in the clockwise direction. When the planetary gear 91 is positioned in the second engaging position, the planetary gear 91 makes contact and engages with the planetary gear 82, which is positioned in the first engaging position in a locked state. At this time, due to the clockwise rotation of the planetary gear 91, a force in the direction that releases the lock works on the planetary gear 82. This cancels out and overcomes the force acting in the direction that locks the planetary gear 82, resulting in the moment on the arm member 84 in the counter-clockwise rotation direction, which makes it possible to forcefully switch the planetary gear mechanism 80. Note that the force that works on the planetary gear 82 to release the lock can be managed by the biasing force of the pressure spring 95 that biases the planetary gear 91 toward the stopper 94*a* and imparts rotation resistance on the arm member 92, and thus the phenomenon in which the planetary gear 82 does not separate can be avoided with certainty.

Accordingly, according to the above embodiment, a locked state in which the transmission gear 71 cannot separate from the planetary gear 82 occurs due to torque that works in the direction opposite to the driving transmission direction and that is caused by the reaction force of the paper during the skew removal; however, this phenomenon by which the planetary gear 82 cannot separate can be avoided by employing a structure in which the planetary gear lock release mechanism 90, having the second planetary gear 91 that engages with the transmission gear 71, is provided and the planetary gear 82 is forcefully separated.

Furthermore, the printer 1 according to the above embodiment includes the gear train mechanism 50, which prevents the transmission gear 71 from stopping the planetary gear 82 due to the rotation of the transmission gear 71 when the planetary gear 82 attempts to separate from the transmission gear 71, which makes it possible to smoothly execute nip-and-release skew removal using the transport driving roller 35 and the intermediate roller 23; this in turn makes it possible to record onto the paper P with precision, having corrected the skew.

Although an exemplary embodiment of the invention has been described thus far with reference to the drawings, the invention is not intended to be limited to the aforementioned embodiment. The forms, combinations, and so on of the various constituent elements illustrated in the aforementioned embodiment are merely exemplary, and many variations based on design requirements and the like are possible without departing from the essential spirit of the invention.

For example, although the aforementioned embodiment described an example in which the recording apparatus is an ink jet printer, the recording apparatus is not limited to an ink jet printer, and may instead be a device such as a copier, a facsimile machine, or the like.

What is claimed is:

1. A sheet material transport apparatus comprising:

a first transport roller and a second transport roller that transport a sheet material; and a gear train mechanism that, when the first transport roller rotates in the forward rotation direction or the backward rotation direction due to the driving force of a rotational means, transmits the rotational driving force of the first transport roller to the second transport roller and causes the second transport roller to undergo slave rotation in the forward rotation direction, wherein the gear train mechanism includes:

a transmission gear that transmits the rotational driving force to the second transport roller;

a sun gear provided so as to engage the first transport roller and that rotates in one of a forward direction and a backward direction based on the rotational driving of the first transport roller;

a first planetary gear, provided so as to engage with the sun gear and to be capable of planetary motion around the sun gear, that is positioned in a first engaging position capable of engaging with the transmission gear when the sun gear undergoes forward-direction rotation and is positioned in a first separated position not capable of engaging with the transmission gear when the sun gear undergoes reverse-direction rotation; and a second planetary gear, provided so as to engage with the transmission gear and to be capable of planetary motion around the transmission gear, the second planetary gear provided so as to engage the first planetary gear in a second engaging position, the second planetary gear being capable of being positioned in a second separated position where the second planetary gear is not engaged with the first planetary gear during forward-direction rotation, wherein while the second planetary gear is in the second separated position the transmission gear engages with the first planetary gear and the transmission gear rotates in the direction that causes the second transport roller to rotate in the forward rotation direction, and the second planetary gear capable of being positioned in a second engaging position where the second planetary gear is engaged with the first planetary gear, wherein while the second planetary gear is in the second engaging position the first planetary gear is positioned in the first engaging position during reverse-direction rotation, a load is placed on the transmission gear by the second transport roller and the transmission gear rotates in the opposite direction to the forward-direction rotation, the second planetary gear applying a force on the first planetary gear in the direction that separates the first planetary gear from the transmission gear due to rotation in the second engaging position.

2. The sheet material transport apparatus according to claim 1, wherein the gear train mechanism includes:

an arm member, provided in a freely-rotatable state with a rotational shaft of the transmission gear serving as the point of support of the arm member, that supports the second planetary gear in a freely-rotatable state; and a spring member that biases the second planetary gear toward the arm member and that applies rotation resistance to the arm member.

3. The sheet material transport apparatus according to claim 2, wherein the gear train mechanism includes a regulating member that regulates the rotation of the arm member between the second separated position and the second engaging position by engaging the arm member so as to hold the arm member in the second separated position or the second engaging position.

4. A recording apparatus comprising:

the sheet material transport apparatus according to claim 3; and a recording unit that performs a recording process on the sheet material transported by the sheet material transport apparatus.

5. A recording apparatus comprising:

the sheet material transport apparatus according to claim 2; and a recording unit that performs a recording process on the sheet material transported by the sheet material transport apparatus.

6. The sheet material transport apparatus according to claim 1, wherein the gear train mechanism includes:

a second transmission gear that engages with the transmission gear and transmits the rotational driving force to the second transport roller; and a third planetary gear, provided so as to engage with the sun gear and to be capable of planetary motion around the sun gear, that is positioned in a third separated position not capable of engaging with the second transmission gear when the sun gear undergoes forward-direction rotation and is positioned in a third engaging position capable of engaging with the second transmission gear when the sun gear undergoes reverse-direction rotation.

7. The sheet material transport apparatus according to claim 6, wherein the gear train mechanism includes a second arm member, provided in a freely-rotatable state with a rotational shaft of the sun gear serving as the point of support of the second arm member, that supports the first planetary gear in a freely-rotatable state and supports the third planetary gear in a freely-rotatable state, and a second spring member that biases the first planetary gear or the third planetary gear toward the second arm member and that applies rotation resistance to the second arm member; and the second arm member is provided so as to be freely rotatable between a forward-direction rotation position in which the first planetary gear is positioned in the first engaging position and the third planetary gear is positioned in the third separated position, and a backward-direction rotation position in which the first planetary gear is positioned in the first separated position and the third planetary gear is positioned in the third engaging position.

8. A recording apparatus comprising:

the sheet material transport apparatus according to claim 7; and a recording unit that performs a recording process on the sheet material transported by the sheet material transport apparatus.

9. A recording apparatus comprising:

the sheet material transport apparatus according to claim 6; and a recording unit that performs a recording process on the sheet material transported by the sheet material transport apparatus.

10. A recording apparatus comprising:

the sheet material transport apparatus according to claim 1; and a recording unit that performs a recording process on the sheet material transported by the sheet material transport apparatus.

* * * * *